US005493738A

United States Patent [19]

Sanderson et al.

[11] Patent Number: 5,493,738

[45] Date of Patent: Feb. 27, 1996

[54] WATER GUIDING STRIP FOR USE IN ASSOCIATION WITH A SHOWER STALL OR BATHTUB

[75] Inventors: Jim Sanderson, Toronto; Brad MacLean, Etobicoke, both of Canada

[73] Assignee: Gordon Sanderson, et al., Toronto, Canada

[21] Appl. No.: 287,329

[22] Filed: Aug. 8, 1994

Related U.S. Application Data

[63] Continuation of Ser. No. 972,690, Nov. 6, 1992.

[51] Int. Cl.[6] ..... A47K 3/22

[52] U.S. Cl. ..... 4/609

[58] Field of Search ..... 4/557, 558, 607–610, 4/658

[56] References Cited

U.S. PATENT DOCUMENTS

| | | |
|---|---|---|
| D. 284,024 | 5/1986 | Olson . |
| 1,791,696 | 2/1931 | Alexander . |
| 1,971,802 | 8/1934 | Zechiel . |
| 3,855,642 | 12/1974 | Blitch . |
| 3,984,880 | 12/1976 | Schrameyer . |
| 4,189,790 | 2/1980 | Masters . |
| 4,473,911 | 10/1984 | Germain . |
| 4,620,332 | 11/1986 | Laird . |
| 4,759,087 | 7/1988 | Zeilinger . |
| 4,944,050 | 7/1990 | Shames et al. . |

*Primary Examiner*—Charles E. Phillips
*Attorney, Agent, or Firm*—Bereskin & Parr

[57] ABSTRACT

A water guiding strip for use in association with a shower stall or bathtub having a shower curtain, this strip having a long thin waterproof body which is flexible at room temperature. The body has an upright leg attachable to an end wall and a horizontal leg attachable to the generally horizontal surface of a bathtub rim. The long thin waterproof body guides water down the end wall along said horizontal surface and into the receptacle without hindering the use of the horizontal surface to store bath articles. The waterproof body may include an offset between the upright leg and the horizontal leg to facilitate capture of moisture on a wet side of the horizontal leg. A mist guard may also be pivotally and removably retained on said upright portion of said long thin body.

22 Claims, 4 Drawing Sheets

WATER GUIDING STRIP FOR USE IN ASSOCIATION WITH A SHOWER STALL OR BATHTUB

This application is a continuation of application Ser. No. 07/972,690 dated Nov. 6, 1992.

FIELD OF THE INVENTION

This invention relates generally to the field of shower stalls and bathtubs. More particularly this invention relates to a device of the type which may be affixed to a shower stall or a bathtub to contain moisture.

BACKGROUND OF THE INVENTION

A typical shower stall or bath enclosure consists of three tiled or otherwise waterproof walls with an open fourth wall. Located at the base of the walls is typically a bathtub. Access to the bathtub is made across the rim of the bathtub beneath the open wall. A shower head is typically provided which when activated will spray water centrally down into the bathtub. To prevent water from escaping during showering, a flexible curtain is typically provided which slides across a fixed rod suspended across the open side above the rim.

Notwithstanding the flexible curtain, problems often arise with the leakage of water from the bathtub or shower enclosure. In the prior art, there are a number of proposals which are directed to solving this problem. For example, in U.S. Pat. No. 4,944,050 a device is shown which attempts to attach the bathtub curtain more directly to the wall of the tub to prevent any water from leaking over the edge of the tub. However, this device is awkward to use, requiring that the connection between the shower curtain and the device be made each time a shower is commenced. Further, the device is not very durable since once connected the shower curtain is likely to rip or tear if bumped accidentally. Finally it is not very effective because water will still tend to migrate to the top of the bathtub rim, where it may then tend to spill out over the edge.

Other devices have been proposed which comprise essentially corner shields or fins to prevent water from migrating from the end wall down onto the rim and then past the corner of the tub onto the floor. Such devices include U.S. Pat. No. 3,855,642 and U.S. Pat. No. 4,9044,050. However, these devices present barriers to entry into the shower enclosure and might well be dangerous if a person were to slip and fall on them. Therefore, these devices are not satisfactory.

One of the most satisfactory prior devices is disclosed in U.S. Pat. No. 4,473,911 which is directed to a bathtub rim water dam. However, there are several problems associated with this water dam which render it ineffective. Firstly, the material used is a very stiff plastic. The plastic has a memory unless it is heated above a certain temperature in which case it will deform non-elastically. To install the device it is necessary to heat the strip of plastic for example over an electrical element of a stove and form a bend in the device to cover the transition between the top surface of the bathtub rim and the inside edge of the bathtub. However, because forming the bend takes place at a position remote from the actual bathtub, it can be very difficult to gauge the exact bend required. Although an adhesive backing is provided, because of the inherent memory of the plastic of this device, the strip often lifts away from the tub due to a difference in the bend achieved and the actual tub surface.

Further, this device as shown extends across the corner of the bathtub which is often a place where bathtub articles are stored. Use of this device therefore removes the corner of the bathtub from being a usable ledge.

Further, water splashing onto the back wall will have a tendency to run down the back wall. As it runs down the back wall it may also have a tendency to spread out. Since the device only extends across the rim, any water coming from above may land on the edge of the strip and may well run down the outside of the tub.

Finally, a portion of the strip extends down into the tub, and gets exposed to soap, hot water, bath oil and the like, which may seriously compromise the adhesive.

SUMMARY OF THE PRESENT INVENTION

What is required is a device which will guide water into the interior of the tub or shower stall without impeding human access over the rim into the shower enclosure. What is also required is a device which is safe to use and will not provide a source of additional injury to a person using the bathtub. What is also required is a device which may be securely attached and which will survive the rigors of the bathtub environment. Therefore according to the present invention there is provided:

A water guiding strip for use in association with a shower stall or bathtub having a receptacle with a drain, in which a person may stand while showering, the receptacle having a rim, the shower stall or bathtub having walls and a shower curtain positionable between said walls and above the rim, the rim having a generally horizontal surface abutting said walls along which water may flow, the water guiding strip comprising:

a long, thin, waterproof body which is flexible, at room temperature, said body having an upright leg attachable to an end wall, and a horizontal leg attachable to said generally horizontal surface of said rim, said body including an inside edge and an outside edge;

wherein said water guiding strip guides water down said end wall along said horizontal surface and into said receptacle without hindering the use of said horizontal surface to store bath articles.

BRIEF DESCRIPTION OF THE DRAWINGS

Turning to FIG. 1 there is shown a shower stall and bathtub enclosure indicated generally at 10 having a side wall 12, a back wall 14 and an end wall 16. At the foot of each of the side, back and end walls 12, 14 and 16 is located a bath tub 18. The side, back and end walls 12, 14 and 16 would typically be covered with waterproof material such as tiles or the like.

Figure 1:
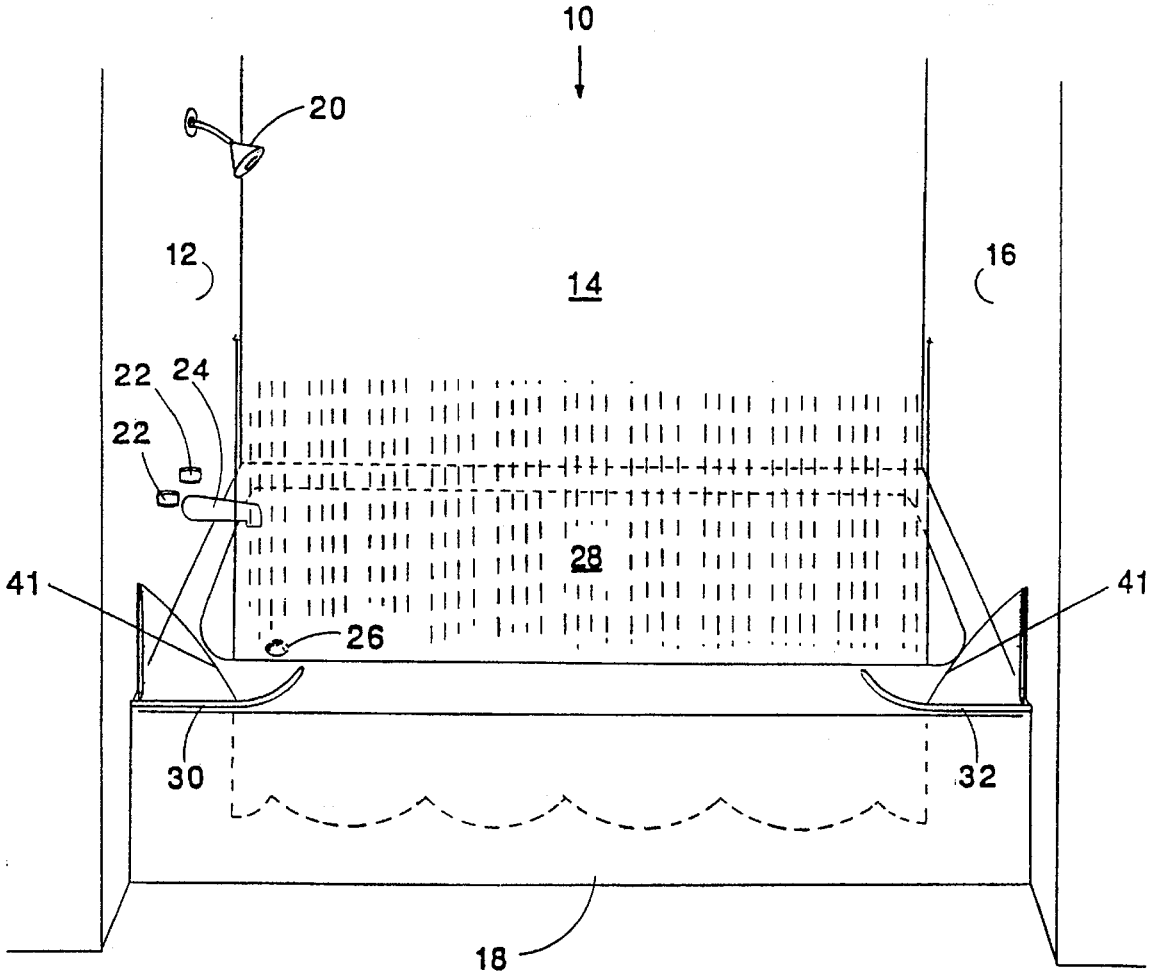
FIG. 1 is a view of a shower or bathtub enclosure having water guiding strips and mist guards positioned in place in accordance with the present invention.

Also shown in the tub enclosure are a shower head 20, taps 22 and a faucet 24. Also shown is a drain 26. The operation of the shower head 20, the taps 22, faucet 24 and the drain 26 are conventional and will be readily understood by those skilled in the art. Therefore, they are not discussed in more detail.

Also shown, partly broken away, is a shower curtain 28. The shower curtain 28 is supported by a rod (not shown) across the open side of the shower stall or bathtub enclosure 10 opposite back wall 14 also in a conventional manner. Two water guiding strips, according to the present invention, are shown at 30 and 32 attached to the side wall 12 and end wall 16 respectively.

Figure 2:
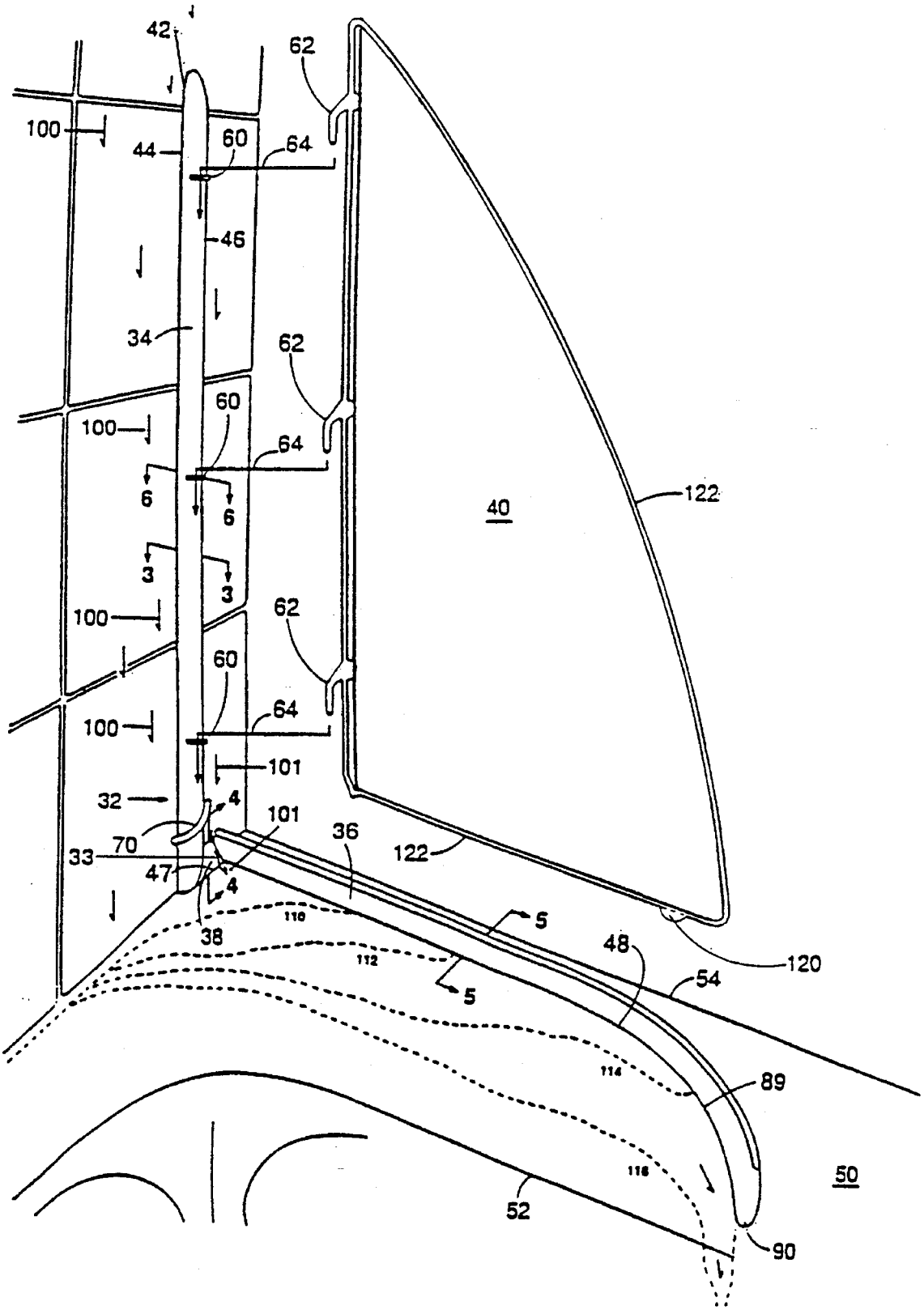
FIG. 2 is a close-up view from inside the enclosure of one water guiding strip and mist guard of FIG. 1.

Turning to FIG. 2, the water guiding strip 32 is shown in enlarged view. It will be appreciated that while the following discussion is directed to the water guiding strip 32, it applies equally to water guiding strip 30. The strips 30, and 32 are identical, except that strip 30 may be considered as a left hand version, and is the mirror image of the right hand version, namely strip 32. As shown in FIG. 2, the water guiding strip 32 is comprised of a upstanding portion 34 which is attached to a generally horizontal portion 36. Between the upstanding portion 34 and the horizontal portion 36 is located an offset 38. Also shown is a mist guard 40.

Beginning at the top of the upstanding portion 34 of the water guiding strip 32 is located an angled or a bevelled edge 42. The purpose of the bevelled edge 42 is to direct any water which may come into contact with the upper end of upstanding portion 34 inwardly, toward an inside edge 44 of the water guiding strip. Opposite the inside edge 44, which may be considered to be the wet side, is an outside edge 46 which may also be referred to herein as the dry side.

As can be seen, the upstanding portion 34 extends down the waterproof wall of the shower or bathtub enclosure until it intersects with an upper rim 50 of the bathtub. The rim 50 includes a wet side 52 and a dry side 54 as shown in FIG. 2.

Figure 6:
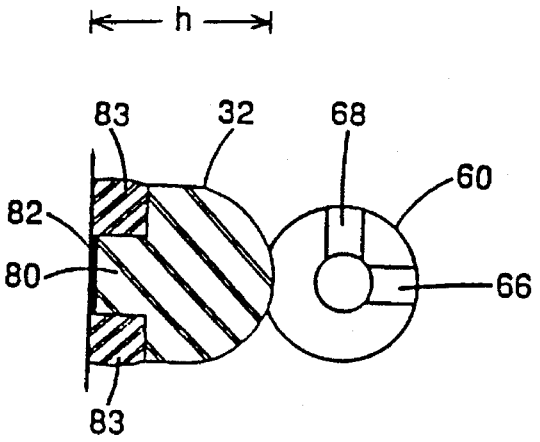
FIG. 6 is a cross sectional view of the water guiding strip of FIG. 2 along lines 6—6.
Figure 7:
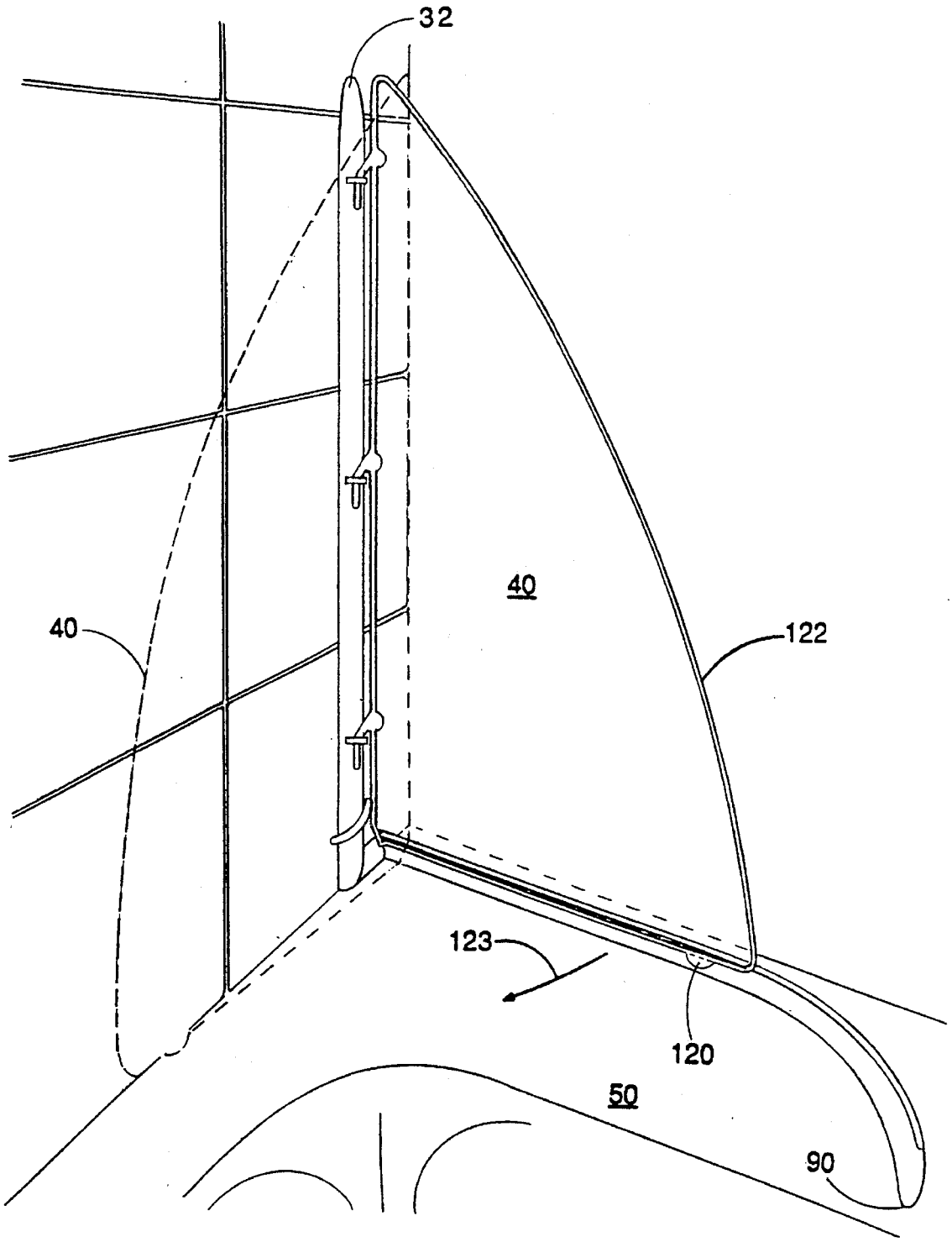
FIG. 7 is a view from inside the bathtub of the water guiding strip and mist guard of FIG. 1 showing the mist guard moveable between an in use position and a storage position.

Also shown on the upstanding portion 34 are gudgeons 60. Although three gudgeons 60 are shown, more or fewer may be used as required. The gudgeons 60 are intended to cooperate with the pintle 62 located on the mist guard 40. Arrows 64 show how the pintle 62 are inserted into the gudgeons 60. In this manner the mist guard 40 is removable for easy cleaning and/or storage. In FIG. 6 a cross sectional view of a gudgeon 60 is shown having detents 66 and 68. These detents may be in the form of shallow grooves which preferentially locate the mist guard 40 in a storage position and an in use position as shown in FIG. 7.

Also shown on the upstanding portion 34 is a micro spiral 70. The purpose of the micro spiral 70 is simply to direct any water flowing down the outside edge of the upstanding portion 34 of the water guiding strip towards the inside or wet side 44. While one type of such a surface treatment is shown, other treatments could be used, such as micro grids or other surface patterns which tend to direct water toward an inside or wet edge 44. Further, as will be appreciated, while the micro spiral 70 is shown, it may not be necessary in all cases for the reasons indicated below.

Figure 3:
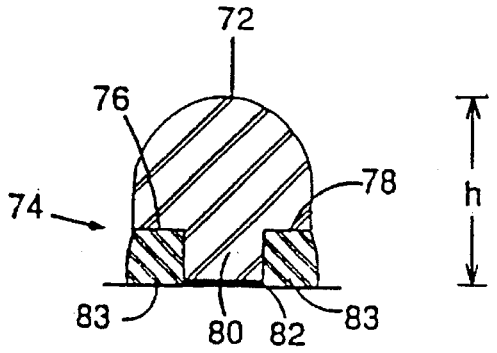
FIG. 3 is a cross sectional view through the water guiding strip of FIG. 2 along line 3—3.

Shown in FIG. 3 is a cross sectional view along lines 3—3 the upstanding portion 34 of the water guiding strip 32. As can be seen, the strip 32 comprises a generally dome-shaped back portion indicated at 72 which overlies a T-shaped attachment portion indicated at 74. Sealant retaining grooves 76 and 78 are formed on opposite sides of a mid-section 80. Preferably the mid-section 80 will come with a self adhesive shown at 82. Sealant is shown as 83. These features are more fully described below with respect to the installation of the invention.

Figure 4:
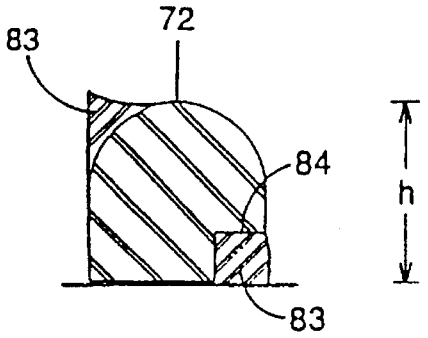
FIG. 4 is a cross sectional view through the water guiding strip of FIG. 2 along section 4—4.

Shown in FIG. 4 is a cross sectional view along lines 4—4 of FIG. 2 of the offset portion 38. As can be seen, only one sealant retaining groove 84 has been formed in this portion, and this sealant retaining groove 84 is along the wet side 47. Also shown is a feathered bead of silicone 83 on the top side abutment of the offset portion 38.

Figure 5:
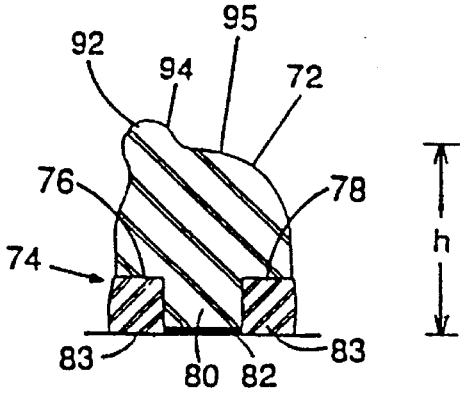
FIG. 5 is a cross sectional view of the water guiding strip of FIG. 2 along lines 5—5.

Turning now to the generally horizontal portion 36 as shown in FIG. 2 it can be seen that first it generally parallels the outside dry edge 54 of the rim 50, then gently curves across the rim 50 to an end 90 which ends short of the wet side 52 of the bathtub rim 50. FIG. 5 shows a cross sectional view of the generally horizontal portion along lines 5—5 in FIG. 2. As can be seen, the generally horizontal portion is similar to the upstanding portion 34 having the domed-shaped back portion 72 overlying T-shaped portion 74 and having sealant retaining grooves 76 and 78. A difference from the upstanding portion 34 though is the addition of a water retaining lip or micro barrier 92. The water retaining lip 92 is shown to be generally rounded, although provided a peak 94 of the water retaining lip 92 is above a top surface 95 of the domed-shaped back portion 72 of the horizontal portion 36, any shape will suffice. The lip 92 increases the wet surface area of the strips 30 and 32.

The installation of the instant invention can now be understood. Prior to installation, it is preferable to thoroughly clean the surfaces to which the strip is to be attached through use of appropriate solvents, cleaners and the like. Once the surface is properly prepared, namely cleaned and dried, application of the instant invention can be made. In order to install the instant invention, one merely attaches the upstanding portion 34 to the vertical side wall of the shower or bathtub enclosure. Then, the horizontal portion 36 is positioned on the horizontal portion of the rim 50 and a curve 89 is formed wherein the tip 90 is directed towards the inside edge 52 of the bathtub but stops short thereof. The strip will be held in position by the self adhesive, which is of the type known in the art.

It will be appreciated that the upstanding portion 34, is shown generally vertical in the plane of the wall but any angle above horizontal could be used. Of course this means that the upstanding portion need not be straight, but could be curved or angled along the wall to suit individual preference. An advantage of having the upstanding portion 34 generally upright, is that its thickness will to a certain extent block spray which might otherwise have gotten past. Also, this provides a vertical pivoting axis for the mist guards 40, 41 should they be used.

Thereafter, a tube of sealant can be used to fill sealant retaining grooves 76, 78 and 84 on the upstanding portion 34, horizontal portion 36, and the offset portion 38, with sealant 83. The sealant 83 can be contoured by fingertip or the like, post application, in a known manner. The sealant 83 has two salutary affects. Firstly, it protects the adhesive 82 from the compromising action of water, soap and the like and secondly it adds adhesive strength to the connection between the upstanding, horizontal and offset portions 34, 36 and 38 and the walls 12, 16 and the bathtub rim 50. This additional adhesive effect is especially beneficial in overcoming surface disconformities, such as may be presented by the grout lines between the tiles. The sealant retaining grooves 76, 78 and 84 enhance the adhesive action of the sealant 83, by increasing the contact area between the sealant 83 and the strip 32. It will be appreciated that be sealing the perimeter of the water guiding strip 32, a complete barrier is made against dirt and bacteria. A preferred sealant 83 is silicone rubber.

It can now be appreciated how the present invention operates. During showering or the like mist and water will be thrown into the air some of which will land against the end wall 16 of the bathtub or shower enclosure 10. As shown in FIG. 2, this water will then travel down in the direction of arrows 100 generally spreading out as it descends. Upon coming into contact with the upstanding portion 34 of the water guiding strip 32, the moisture will be guided downwardly to the wet side of the generally horizontal portion. Even if water comes into contact with the dry side of the upstanding portion 34 or the wall area bounded by the upstanding portion 34 and the offset portion 38, the water will migrate downwardly due to gravity, and then is directed over the offset 38 into the wet side 47 of the generally horizontal portion 36 as shown by drop 101. As shown, the water will begin to accumulate with an edge of the puddle or reservoir being approximated by lines 110, 112, 114, and 116 with each successive line representing more water. As can be seen, by the time an amount of water equal to the line depicted by 116 has accumulated it will flow over the edge and down the inside or wet side 52 of the rim 50. Once flow begins, the reservoir almost completely empties, due to surface tension effects. Once inside the bathtub of course it will be directed toward the drain 26 in the normal manner.

It will be appreciated that the offset 38 is important to ensure that water running down the upstanding portion 34, even if such water migrates to the outside edge 46 will as it travels down, be deposited and contained behind the horizontal portion 36. Thus the offset may make any water directing surface treatments (such as the micro spiral 70) of the upstanding portion 34 unnecessary, since regardless of which side the water runs down, it will be captured behind the horizontal portion 36. The offset 38 has an additional advantage, in that the horizontal portion may be easily folded up parallel to the upstanding portion 34 for packaging purposes.

As will be appreciated, by orienting the water guiding strip 32 in the manner shown, full access to the corner of the bathtub, for the purpose of storing shampoo bottles, bathtub toys, drain plugs, soap or the like, can be had. These articles may be stored in the reservoir area without impeding the water guiding function of the water guiding strip 32. Further, the end 90 stops short of the edge of the rim 50, limiting exposure of the adhesive to the any compromising bathtub fluids.

The most preferred form of the present invention is of a soft rubber or plastic which is essentially invisible to the touch. While preferably the material should be formed from a solid section, hollow sections may also be used. A type of rubber which would be suitable is commonly known as surgical rubber. This can be easily stood upon or leaned upon without injuring the person coming into contact with the rubber. Preferably it should not even be noticed if stood upon or the like. Additionally, by being very flexible at room temperatures, the water guiding strip 32 can easily and effectively be positioned for maximum effect. For example, a flexible consistency will allow the strip 32 to be correctly positioned even if the angle between the tub rim 50 and adjoining wall is not 90°. Further the curve 89 (in post-production state) can be made to easily fit larger and smaller width rims. Finally, by being flexible, the tub strips 30 and 32 may be easily stored or packed in a folded manner. It would be preferred to package a tube of sealant together with the tub strips.

Thus it may be seen that the upstanding portion is flexibly connected to the horizontal portion. In the preferred embodiment this flexible connection arises because of the natural flexibility of the material. However it will be appreciated that other ways of achieving the same effect are possible, such as by making the body from two independent pieces, with an overlap or joint (shown as dotted line 33) which allows each piece to be placed independent of the other, yet forms a water barrier dam as described herein. In this sense flexible connection means that the upstanding portion can be sealed to the wall, and the horizontal portion can be sealed to the rim, independently of the angle between the rim and the wall. The flexibility allows a good seal along both portions.

Preferably the upstanding portion 34 would be 10" to 20" high and the horizontal portion would be approximately 10" to 12" long. The preferred dimensions of the water guiding strip include a height of 7/16 inch and a width of 7/16". The offset portion is preferably ¼"–1.5" long. The sealant returning grooves are preferably ⅛" square to 3/32" square. While the foregoing parameters are preferred, other dimensions may also be used with desirable effect.

It will now be appreciated that the preferred dimensions noted above yield a device which has a length, of each leg, many times its height. In this sense height means the distance from the outermost edge of the body to the surface, either the horizontal surface, or to the end wall, to which the body is mounted. For clarity, this distance is shown as 'h' in FIGS. 3 to 6. The height does not include the gudgeons. For example, a height of 7/16" for the upstanding leg of 10" to 20" long yields a range of height to length ratio of 0.04375 to 0.021875. This ratio will be referred to herein as an aspect ratio for the upstanding leg. The aspect ratio for the horizontal leg is 0.04375 to 0.0365. Generally, aspect ratios in this magnitude are preferred, because a lower aspect ratio means the height of the strip is small compared to its length. Since generally, the strip would not be practical if made too thick (i.e. like a full fin) the height should be less than 1", and preferably less than ½". Thus, the preferred invention would have an aspect ratio below 0.1, and most preferably below about 0.05.

Turning now to FIG. 7, it can be seen more fully how the present invention can be used in conjunction with the mist guard 40. The mist guard 40 swings on the pintle 62 placed in the gudgeons 60. A rubber tab end 120 is provided which acts as a stop. The purpose of the pintles 62 and the rubber end tab 120 is to prevent damaging torque from being applied to the upstanding portion 34 of the water guiding strips 30, 32 as well as the mist guard 40. Further, the rubber end tab 120 is preferably angled, and so will accommodate variations in the angle between the end wall and the bathtub rim 50 in case such angle is not 90°, as may frequently be the case. If it is greater than 90° then the rubber end tab 120 will contact the domed portion 72. If it is less, then the rubber end tab 120 will contact the bathtub rim 50 and deform. The pintles 62 will float in the gudgeons 60 to allow the mist guard 40 to ride up and over such an obstacle. Additionally, the rubber end 120 will ride over the horizontal portion of the strip in the event the mist guard 40 is accidentally kicked or bumped, so that the mist guard 40 swings outwardly away from the bathtub. In this regard the preferred dimension for the pintle is about one inch long. This push away feature adds to the safety of this invention.

Also shown are rounded edges 122 which surround the perimeter of the mist guard 40. These rounded edges 122 form a perimeter stiffener to the mist guard 40 and again add to its safety since they are rounded. The preferred consistency for the mist guard 40 is a relatively soft or rubbery one, with sufficient stiffness of course to remain in position.

When resting on the rubber end tab 120 in the in use position, the mist guard 40 directs any water splashes or mist downwardly onto the wet side 48 of the horizontal portion of the strip 32 and into the reservoir. When not in use, the mist guard 40 may be stored in an out of the way position as illustrated in FIG. 7. This is accomplished by merely riding the pintle 62 over the detents 68 and allowing the mist guard 40 to slide into the storage position detents 66 by swinging mist guard 40 in direction of arrow 123. As will be appreciated, the opposite occurs as mist guard 41 is manipulated.

The mist guard 40 and water guiding strip 32 may be formed from any suitable transparent plastic, in order to be less visible and to blend into the bathroom colour scheme. Alternatively, they both and may be provided in decorator colours or with art work for consumer appeal.

It will be appreciated by those skilled in the art that the foregoing description is in relation to a preferred embodiment and that various alterations or variations may be made without departing from the broad scope of the appended claims. For example, while the water guiding strip is shown in association with a mist guard it would still function in the absence of such a mist guard. Some of these variations will be apparent to those skilled in the art and others have been specifically articulated.

We claim:

1. A water guiding strip for use in association with a shower stall or bathtub having a receptacle with a drain in which a person may stand while showering, the receptacle having a rim, the shower stall or bathtub having walls and a shower curtain positionable between said walls and above the rim, the rim having a generally horizontal surface abutting said walls along which water may flow, the water guiding strip comprising:

a waterproof body which is flexible at room temperature, said body having a generally elongated upstanding leg attachable to an end wall, and a generally elongated horizontal leg attachable to said generally horizontal surface of said rim, each of said upstanding leg and said horizontal leg of said body including an inside edge and an outside edge, each of said upstanding leg and said horizontal leg having an average height, and a length, wherein the aspect ratio of the average height to length is less than 0.1;

wherein said strip further includes an offset portion between the upstanding leg and the horizontal leg;

wherein said inside edge of said horizontal leg is outside of said outside edge of said upstanding leg; and, wherein said water guiding strip guides water down said end wall along said horizontal surface and into said receptacle without hindering the use of said horizontal surface to store bath articles.

2. A water guiding strip as claimed in claim 1 wherein said horizontal leg is positionable on said rim to include a laterally curved portion which traverses the rim towards an inside of the shower stall, and wherein said aspect ratio is less than 0.05.

3. A water guiding strip as claimed in claim 2 wherein said curved portion is positionable to end short of an inside edge of the rim.

4. A water guiding strip as claimed in claim 2 wherein said horizontal portion is further positionable to include a generally straight portion running generally parallel to an edge of the rim.

5. A water guiding strip as claimed in claim 4 wherein said generally straight portion is located closer to an outer edge of said rim than an inner edge.

6. A water guiding strip as claimed in claim 1 wherein said upstanding portion is generally vertical.

7. A water guiding strip as claimed in claim 1 wherein said upstanding leg ends at a peak, the top of said peak being located adjacent to said outside edge of said body.

8. A water guiding strip as claimed in claim 1 wherein said body is generally semicircular in cross sectional profile and includes an adhesive backing located on at least a portion of the diameter for attaching the body to said end wall and said rim with the curved part of the cross sectional profile facing outwardly.

9. A water guiding strip as claimed in claim 8 wherein said adhesive backing ends short of said inside edge of said body and said body includes at least one sealant retaining groove.

10. A water guiding strip as claimed in claim 8 wherein said adhesive backing ends short of both edges of said body and said body includes sealant retaining grooves on both sides of the body to prevent water from contacting the adhesive when said strip is in use.

11. A water guiding strip as claimed in claim 8 wherein said body includes a water retaining barrier on said curved part of said cross sectional profile.

12. A water guiding strip as claimed in claim 11 wherein said water retaining barrier is located closer to the outside edge of the body that the inside edge.

13. A water guiding strip as claimed in claim 8 further including at least one means for directing water located on a surface of said body.

14. A water guiding strip as claimed in claim 13 further including a water retaining lip running along said body and wherein said means for directing water generally directs water across said body.

15. A water guiding strip as claimed in claim 14 wherein said means for directing water comprises at least one inwardly directed spiral for at least a portion of said upstanding portion of said body.

16. A water guiding strip as claimed in claim 1 further including a mist guard positionable generally between the upstanding portion and the horizontal portion, the mist guard, in use, directing droplets downwardly behind said inside edge of said horizontal portion.

17. A water guiding strip as claimed in claim 16 wherein each of said body and said mist guard include one of cooperating pintle and gudgeons to pivotally retain said mist guard onto said body, wherein said mist guard may be pivoted between a position flush against an inside wall of said enclosure to a position extended out from said rim.

18. A water guiding strip for use in association with a shower stall or bathtub having a receptacle with a drain in which a person may stand while showering, the receptacle having a rim, the shower stall or bathtub having walls and a shower curtain positionable between said walls and above the rim, the rim having a generally horizontal surface abutting said walls along which water may flow, the water guiding strip comprising:

a waterproof body which is flexible at room temperature, said body having a generally elongated upstanding leg attachable to an end wall, and a generally elongated horizontal leg attachable to said generally horizontal surface of said rim, each of said upstanding leg and said horizontal leg of said body including an inside edge and an outside edge, each of said upstanding leg and said horizontal leg having an average height, and a length, wherein the aspect ratio of the average height to length is less than 0.1;

wherein said body is generally semicircular in cross-sectional profile and includes an adhesive backing located on at least a portion of the diameter for attaching the body to said end wall and said rim with the curved part of the cross-sectional profile facing outwardly, and wherein said adhesive backing ends short of said inside edge of said body and said body includes at least one sealant retaining groove; and, wherein said water guiding strip guides water down said end wall along said horizontal surface and into said receptacle without hindering the use of said horizontal surface to store bath articles.

19. A water guiding strip for use in association with a shower stall or bathtub having a receptacle with a drain in which a person may stand while showering, the receptacle having a rim, the shower stall or bathtub having walls and a shower curtain positionable between said walls and above the rim, the rim having a generally horizontal surface abutting said walls along which water may flow, the water guiding strip comprising:

a waterproof body which is flexible at room temperature, said body having a generally elongated upstanding leg attachable to an end wall, and a generally elongated horizontal leg attachable to said generally horizontal surface of said rim, each of said upstanding leg and said horizontal leg of said body including an inside edge and an outside edge, each of said upstanding leg and said horizontal leg having an average height, and a length, wherein the aspect ratio of the average height to length is less than 0.1;

wherein said body is generally semicircular in cross-sectional profile and includes an adhesive backing located on at least a portion of the diameter for attaching the body to said end wall and said rim with the curved part of the cross-sectional profile facing outwardly, and wherein said adhesive backing ends short of both edges of said body and said body includes sealant retaining grooves on both sides of the body to prevent water from contacting the adhesive when said strip is in use; and, wherein said water guiding strip guides water down said end wall along said horizontal surface and into said receptacle without hindering the use of said horizontal surface to store bath articles.

20. A water guiding strip for use in association with a shower stall or bathtub having a receptacle with a drain in which a person may stand while showering, the receptacle having a rim, the shower stall or bathtub having walls and a shower curtain positionable between said walls and above the rim, the rim having a generally horizontal surface abutting said walls along which water may flow, the water guiding strip comprising:

a waterproof body which is flexible at room temperature, said body having a generally elongated upstanding leg attachable to an end wall, and a generally elongated horizontal leg attachable to said generally horizontal surface of said rim, each of said upstanding leg and said horizontal leg of said body including an inside edge and an outside edge, each of said upstanding leg and said horizontal leg having an average height, and a length, wherein the aspect ratio of the average height to length is less than 0.1;

wherein said body is generally semicircular in cross-sectional profile and includes an adhesive backing located on at least a portion of the diameter for attaching the body to said end wall and said rim with the curved part of the cross-sectional profile facing outwardly;

wherein said strip includes at least one means for directing water located on a surface of said body and includes a water retaining lip running along said body and wherein said means for directing water generally directs water across said body; and, wherein said water guiding strip guides water down said end wall along said horizontal surface and into said receptacle without hindering the use of said horizontal surface to store both articles.

21. A water guiding strip for use in association with a shower stall or bathtub having a receptacle with a drain in which a person may stand while showering, the receptacle having a rim, the shower stall or bathtub having walls and a shower curtain positionable between said walls and above the rim, the rim having a generally horizontal surface abutting said walls along which water may flow, the water guiding strip comprising:

a waterproof body which is flexible at room temperature, said body having a generally elongated upstanding leg attachable to an end wall, and a generally elongated horizontal leg attachable to said generally horizontal surface of said rim, each of said upstanding leg and said horizontal leg of said body including an inside edge and an outside edge, each of said upstanding leg and said horizontal leg having an average height, and a length, wherein the aspect ratio of the average height to length is less than 0.1;

wherein said strip further includes a mist guard positionable generally between the upstanding portion and the horizontal portion, the mist guard, in use, directing droplets downwardly behind said edge of said horizontal portion, and wherein each of said body and said mist guard include one of co-operating pintle and gudgeons to pivotally retain said mist guard onto said body, wherein said mist guard may be pivoted between a position flush against an inside wall of said enclosure to a position extended out from said rim; and, wherein said water guiding strip guides water down said end wall along said horizontal surface and into said receptacle without hindering the use of said horizontal surface to store both articles.

22. A water guiding strip as claimed in claim 21 wherein said gudgeons are provided with at least one detent to preferentially locate the mist guard in position.

* * * * *